US009263810B2

(12) United States Patent
Noh

(10) Patent No.: US 9,263,810 B2
(45) Date of Patent: Feb. 16, 2016

(54) CLAMP FOR CONNECTING BATTERY TERMINALS

(71) Applicant: Hyundai Motor Company, Seoul (KR)

(72) Inventor: Seung Hun Noh, Jeollabuk-do (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 0 days.

(21) Appl. No.: 14/476,348

(22) Filed: Sep. 3, 2014

(65) Prior Publication Data

US 2015/0147921 A1 May 28, 2015

(30) Foreign Application Priority Data

Nov. 26, 2013 (KR) ..... 10-2013-0144236

(51) Int. Cl.
*H01R 4/44* (2006.01)
*H01R 11/28* (2006.01)

(52) U.S. Cl.
CPC ..... *H01R 11/283* (2013.01)

(58) Field of Classification Search
CPC .. H01R 12/716; H01R 13/635; H01R 43/027; H01R 4/44; H01R 4/489; H01R 4/5083; H01R 4/5091
USPC ..... 439/770
See application file for complete search history.

(56) References Cited

U.S. PATENT DOCUMENTS

| | | | | | |
|---|---|---|---|---|---|
| 1,968,432 | A | * | 7/1934 | Wilson | 439/388 |
| 5,088,941 | A | * | 2/1992 | Nolle | 439/762 |
| 5,302,143 | A | * | 4/1994 | Inoue et al. | 439/762 |
| 5,454,741 | A | * | 10/1995 | Okada | 439/762 |
| 5,547,403 | A | * | 8/1996 | Haberstroh et al. | 439/763 |
| 6,817,908 | B2 | * | 11/2004 | Freitag | 439/763 |
| 2004/0087219 | A1 | | 5/2004 | Freitag | |

FOREIGN PATENT DOCUMENTS

| | | | |
|---|---|---|---|
| JP | 06-028994 | A | 2/1994 |
| JP | 2002-184389 | A | 6/2002 |
| JP | 2004-235135 | A | 8/2004 |
| KR | 20-0363045 | Y1 | 9/2004 |
| KR | 10-0821595 | B1 | 4/2008 |
| KR | 10-2009-0049458 | A | 5/2009 |
| KR | 10-0900314 | B1 | 6/2009 |
| KR | 10-2010-0018634 | A | 2/2010 |
| KR | 10-2013-0013940 | A | 2/2013 |
| WO | 2011/036551 | A1 | 3/2011 |

* cited by examiner

*Primary Examiner* — Briggitte R Hammond
(74) *Attorney, Agent, or Firm* — McDermott Will & Emery LLP

(57) ABSTRACT

A clamp for freely connecting sheet metal terminals made of a battery in a lateral or vertical direction suitable for working environment is provided. A bolt and a nut connecting both walls are parallel to each other at an open end. Wedge-shaped recesses, into which chamfers of the terminal units are inserted, are formed on inner sides of the walls facing each other. The clamp tightens the terminal units using the wedge-shaped recesses and enables a vertical connection and a lateral connection.

6 Claims, 5 Drawing Sheets

VERTICAL CONNECTION

LATERAL CONNECTION

LATERAL CONNECTION

VERTICAL CONNECTION TYPE

LATERAL CONNECTION TYPE

VERTICAL CONNECTION

--Prior Art--

LATERAL CONNECTION

--Prior Art--

CLAMP FOR CONNECTING BATTERY TERMINALS

CROSS-REFERENCE TO RELATED APPLICATION

This application claims under 35 U.S.C. §119(a) the benefit of priority to Korean Patent Application No. 10-2013-0144236 filed on Nov. 26, 2013, the entire contents of which are incorporated herein by reference.

TECHNICAL FIELD

The present disclosure relates to a clamp for connecting terminals of a battery, and more particularly, to a clamp for freely connecting sheet metal terminals made of a battery in a lateral or vertical direction suitable for working environment.

BACKGROUND

In general, a battery provided in a vehicle generates and supplies electricity to operate various electric devices used in the vehicle. The battery is installed at a side of an engine compartment or a trunk compartment to be charged by a generator and supplies electric power necessary for ignition of an engine and the various electric devices such as head lights. For example, a charging device is activated to supply electricity to the various electric devices when the engine of the vehicle is driven at a desired revolution per minute (RPM), but the battery supplies the electricity in behalf of the charging device when the engine is driven at low RPM or stopped.

In general, the battery is provided with a positive post and a negative post which are connected to power cables. For example, the posts of the battery protrude from an upper side of the battery and cable terminals provided at ends of the power cables, such as the cable terminals are connected to the battery posts, have accommodating recess to accommodate the battery posts and open sides for easy insertion. The open sides of the cable terminals are coupled by bolts and nuts with a clamp so that the battery is electrically connected to the power cables.

The existing connecting structure of battery terminals, for example sheet metal battery terminals, as illustrated in FIGS. 4A and 4B, are classified by a vertical connecting type and a lateral connecting type based on a connecting direction. However, the connecting direction of the existing battery terminals is fixed. Therefore, since the battery terminals are suitable for the working environment, another type of battery terminals need to be developed.

In order to solve the above-mentioned drawbacks, Korean Patent No. 10-0900314 has proposed a structure of connecting a battery terminal in several directions with a circular clamp. However, the structure using a circular clamp has difficulty of keeping a fixed state at a desired angle, so that a connecting force is poor and the clamp is moved due to aging, shock, and vibration resulting in inferior connection of the terminal.

SUMMARY OF THE DISCLOSURE

The present disclosure provides a clamp for connecting a battery terminal for improving workability of easily connecting a sheet metal terminal in a lateral or vertical direction suitable for a working environment by implementing a new type battery terminal connection structure to connect a battery terminal using a clamp having a wedge-shaped recess to connect the sheet metal battery terminal to a battery post in the lateral direction and the vertical direction.

In accordance with an exemplary embodiment of the present disclosure, a clamp for connecting a battery terminal as a device connected to terminal units of the battery terminal to tighten the terminal units is provided. A bolt and a nut connecting both walls are parallel to each other at an open end. Sedge-shaped recesses, into which chamfers of the terminal units are inserted, are formed on inner sides of the walls facing each other. The clamp tightens the terminal units using the wedge-shaped recesses and enables a vertical connection and a lateral connection.

In a vertical connection, the terminal units are tightened by a pressure due to a slide contact between the wedge-shaped recesses of the walls and the chamfers of the terminal units. In a lateral direction, the terminal units are tightened by a force of which the wedge-shaped recesses of the walls directly push the chamfers of the terminal units in a direction where the chamfers are tightened.

A change between the vertical connection and the lateral connection is performed by rotating the walls by 90 degrees in the state where the terminal units are inserted into the walls. To this end, edges of the wedge-shaped recesses of the walls and edges of the terminal units are rounded.

The clamp for connecting a battery terminal according to the present disclosure has following advantages:

First, since the connecting direction can be freely changed for the connection of a sheet metal terminal in working environment;

Second, investment cost can be saved because there is not a need to develop a new terminal suitable for various connecting directions; and Third, the clamp can conveniently work for a change from a vertical type to a lateral type.

BRIEF DESCRIPTION OF THE DRAWINGS

The above and other features of the present disclosure will now be described in detail with reference to certain exemplary embodiments thereof illustrated the accompanying drawings which are given hereinbelow by way of illustration only, and thus are not limitative of the present disclosure.

Figure 1A:
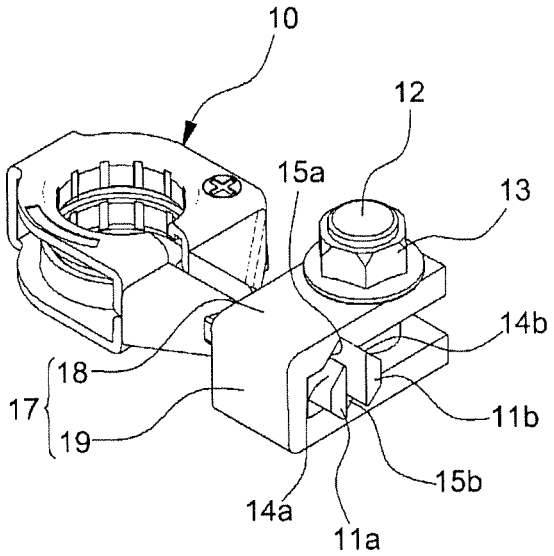
FIGS. 1A and 1B are perspective views illustrating a clamp for connecting a battery terminal according to an embodiment of the present disclosure.

It should be understood that the appended drawings are not necessarily to scale, presenting a somewhat simplified representation of various preferred features illustrative of the basic principles of the disclosure. The specific design features of the present disclosure as disclosed herein, including, for example, specific dimensions, orientations, locations, and shapes will be determined in part by the particular intended application and use environment. In the figures, reference numbers refer to the same or equivalent parts of the present disclosure throughout the several figures of the drawing.

DETAILED DESCRIPTION

Hereinafter, exemplary embodiments of the present disclosure will be described in detail with reference to the accompanying drawings.

Figure 1B:
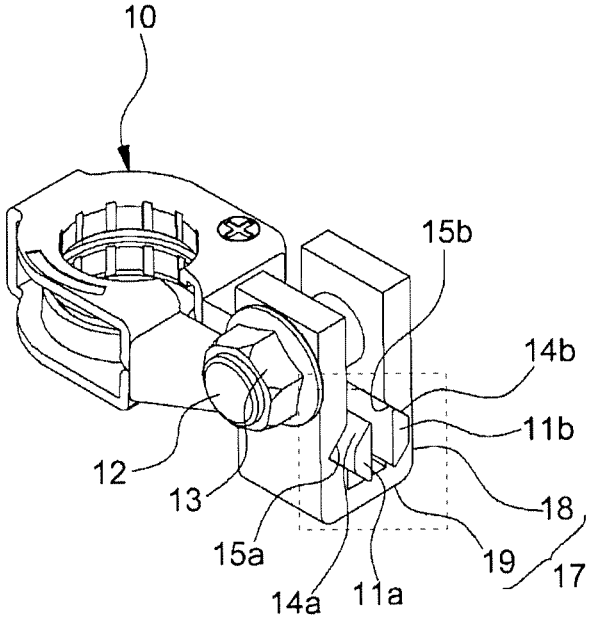
Figure 1C:
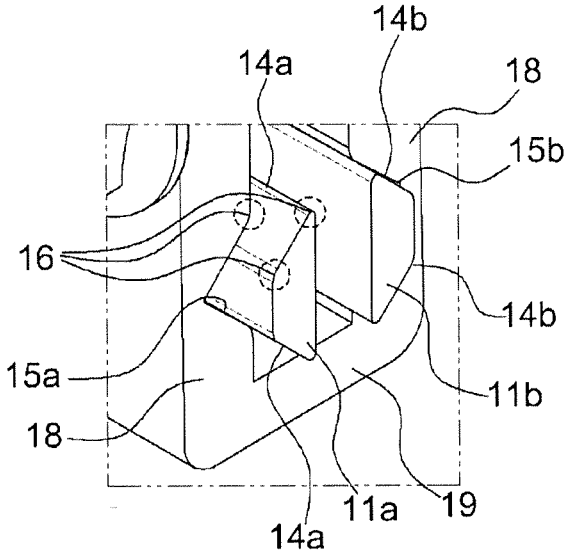
FIG. 1C is an exploded sectional view of FIG. 1B.

FIGS. 1A and 1B are perspective views illustrating a clamp for connecting a battery terminal according to an embodiment of the present disclosure. FIG. 1C is an exploded sectional view of FIG. 1B.

As illustrated in FIGS. 1A-1C, a clamp for connecting a battery terminal according to an embodiment of the present disclosure is connected to a terminal unit of the battery terminal to clamp the terminal unit and to easily connect the battery terminal by changing a connection direction in a lateral or vertical direction suitable for working environment using a combination of a wedge-shaped recess formed in a clamp body side and a chamfer formed in a battery terminal side.

To this end, a clamp body 17 for the connection of a battery terminal has an U-shape including both walls 18 spaced away by a distance in parallel and a connector 19 connecting one side of the walls 18. A bolt 12 and a nut 13 are provided at an open side of the clamp body 17, that is, open sides of the walls 18 wherein the walls 18 may be tightened by screwing the bolt 12 and the nut 13 so that terminal units 11*a* and 11*b* of a battery terminal 10 between the walls 18 may be also pressed and tightened between the walls 18. The walls 18 of the clamp body 17 have wedge-shaped recesses 15*a* and 15*b* respectively formed at positions facing each other, wherein the wedge-shaped recesses 15*a* and 15*b* face each other from inner sides of the walls 18 to form a symmetric shape.

Chamfers 14*a* and 14*b* are formed on a respective outer side of the terminal units 11*a* and 11*b* of the battery terminal 10 to correspond to the wedge-shaped recesses 15*a* and 15*b* of the walls 18. The chamfers 14*a* and 14*b* are made by cutting off rectangular corners of the terminal 10 by an angle and may be provided a pair on the respective terminal units 11*a* and 11*b*. Thus, for the connection of the clamp to the battery terminal 10, the terminal units 11*a* and 11*b* are disposed between the walls 18 of the clamp body 17. In this state, some portion of the terminal units 11*a* and 11*b* are inserted into the wedge-shaped recesses 15*a* and 15*b* in the walls 18, and the chamfers 14*a* and 14*b* on the terminal units 11*a* and 11*b* are in close contact with the wedge-shaped recesses 15*a* and 15*b*.

For example, in a case of a vertical connection, the terminal units 11*a* and 11*b* may be disposed between the walls 18 such that inner ends of the chamfers 14*a* and 14*b* are inserted into and in contact with the wedge-shaped recesses 15*a* and 15*b*. In a case of a lateral connection, the terminal units 11*a* and 11*b* may be disposed between the walls 18 such that outer ends of the chamfers 14*a* and 14*b* are inserted into and in contact with the wedge-shaped recesses 15*a* and 15*b* while the outer sides of the terminal units are inserted thereinto. In this case, upon the lateral connection, there may be a space between the outer sides of the terminal units 11*a* and 11*b* and inner sides neighboring corners of the wedge-shaped recesses 15*a* and a15*b*.

Edges of the wedge-shaped recesses 15*a* and 15*b* of the walls 18, that is, boundaries where the inner sides of the walls 18 face the wedge-shaped recesses 15*a* and 15*b* and edges of the chamfers 14*a* and 14*b* of the terminal units 11*a* and 11*b*, that is, boundaries where both lateral-side ends of the chamfers and the inner sides and the outer sides of the terminal units 11*a* and 11*b* meet are rounded ends 16. Here, the rounded ends 16 enable the clamp smoothly rotate for the change from the vertical connection of the clamp to the lateral connection or from the lateral connection to the vertical connection.

Figure 2A:
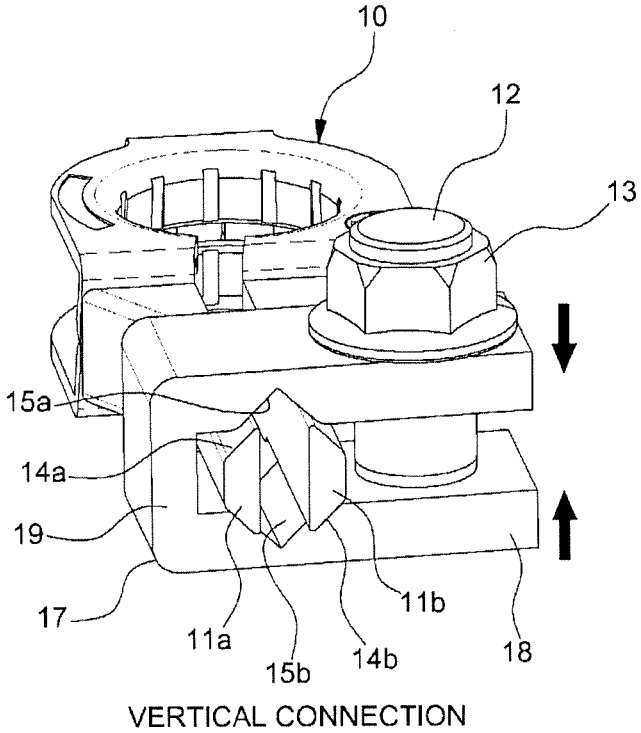
FIG. 2A is a perspective view illustrating a vertical connection state of a clamp for connecting a battery terminal according to an embodiment of the present disclosure.
Figure 2B:
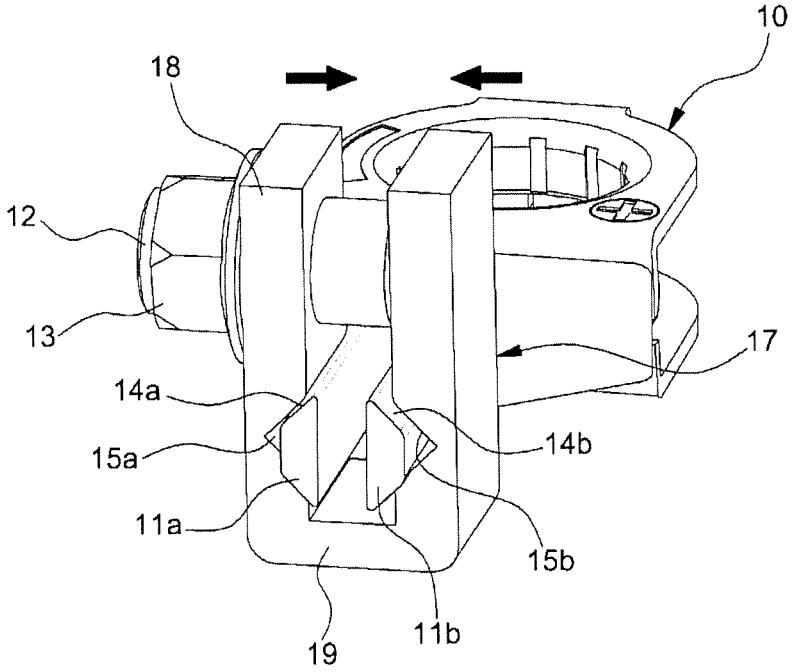
FIG. 2B is a perspective view illustrating a lateral connection state of a clamp for connecting a battery terminal according to an embodiment of the present disclosure.
Figure 3A:
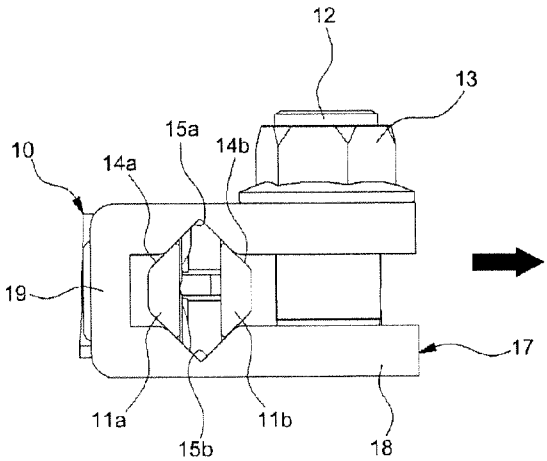
FIGS. 3A-3D perspective views illustrating a connection direction change of a clamp for connecting a battery terminal according to an embodiment of the present disclosure.
Figure 3B:
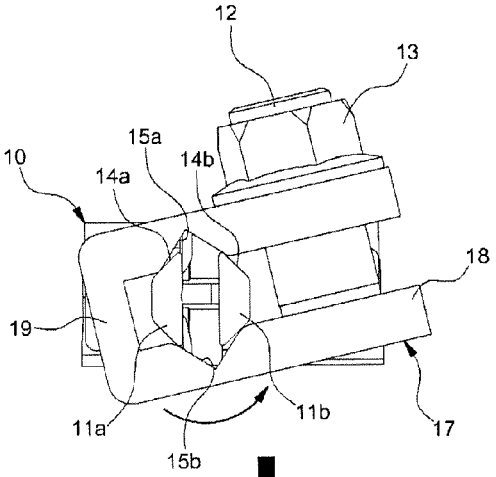
Figure 3C:
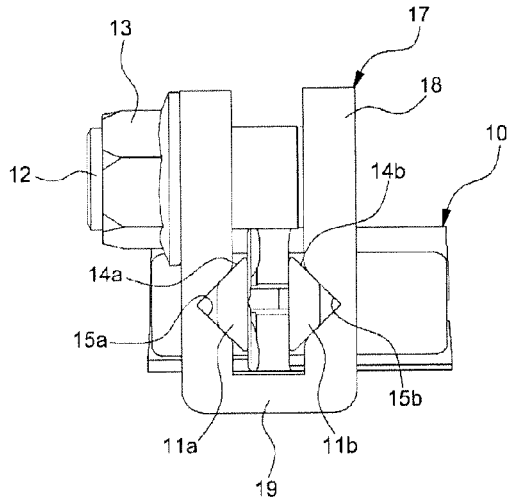
Figure 3D:
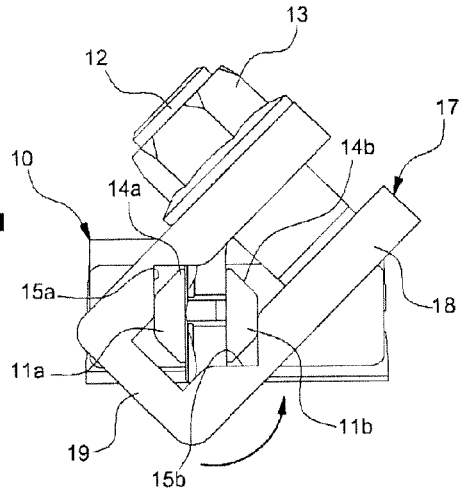
Figure 4A:
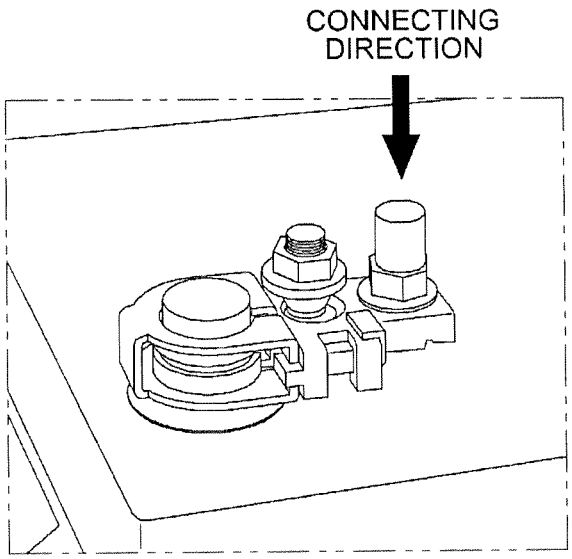
FIG. 4A is a photograph illustrating vertical connection of a battery terminal according to an existing clamp.
Figure 4B:
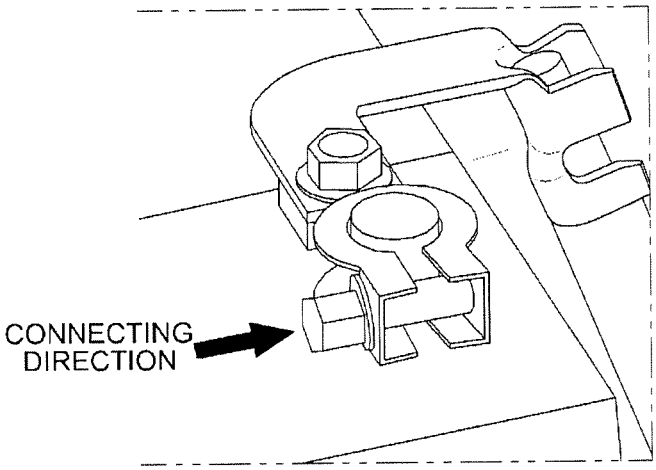
FIG. 4B is a photograph illustrating lateral connection of a battery terminal according to an existing clamp.

FIG. 2A is a perspective view illustrating a vertical connection state of a clamp for connecting a battery terminal according to an embodiment of the present disclosure. FIG. 2B is a perspective view illustrating a lateral connection state of a clamp for connecting a battery terminal according to an embodiment of the present disclosure. As illustrated in FIGS. 2A and 2B, the vertical connection and the lateral connection of the clamp to the battery terminal are shown respectively.

In a case of the vertical connection, the bolt 12 in the walls 18 and the nut 13 of the clamp body 17 are screwed to each other such that the walls 18 of the clamp body 17 are tightened. At this time, the chamfers 14*a* and 14*b* of the terminal units 11*a* and 11*b* are inserted into the wedge-shaped recesses 15*a* and 15*b* of the walls 18 resulting in tightening the terminal units 11*a* and 11*b*. That is, in the vertical connection, the terminal units 11*a* and 11*b* may be tightened by pressure due to the slide contact between the wedge-shaped recesses 15*a* and 15*b* of the walls 18 and the chamfers 14*a* and 14*b* of the terminal units 11*a* and 11*b*. The walls 18 are shrunk in the vertical direction as indicated by arrows in FIG. 2A, and the terminal units 11*a* and 11*b* are tightened in the lateral direction as indicated by arrows in FIG. 2A due to shapes of the wedge-shaped recesses 15*a* and 15*b* and the chamfers 14*a* and 14*b*.

In the lateral connection, since the clamp and the terminal units are tightened in the same direction when the bolt 12 and the nut 13 of the walls 18 of the clamp body 17 are fastened to each other, the terminal units 11*a* and 11*b* are tightened. In other words, in a case of the lateral connection, the terminal units 11*a* and 11*b* may be tightened by a force of which the wedge-shaped recesses 15*a* and 15*b* of the walls push the chamfers 14*a* and 14*b* directly in the direction to be tightened. The walls 18 are tightened in the lateral direction as indicated by arrows in FIG. 2B, and the clamp and the terminal units are already in contact with each other so that the terminal units are tightened in the lateral direction in FIG. 2B where the clamp is tightened as indicated by arrows in FIG. 2B.

FIGS. 3A-3D perspective views illustrating connection direction change of the clamp for connecting a battery terminal according to an embodiment of the present disclosure. As illustrated in FIGS. 3A-3D, the change from the vertical connection to the lateral connection of the clamp to the battery terminal is shown.

In the case when the vertical connection is changed to the lateral connection, the change of a connection type is carried out by which the walls 18 are rotated by 90 degrees while the terminal units 11*a* and 11*b* are inserted into the walls 18. That is, when the clamp is rotated counterclockwise, the clamp cross over the terminal units and the clamp and the terminal units are overlapped somewhat. For example, since the chamfers 14*a* and 14*b* of the terminal units 11*a* and 11*b* or the outer sides of the terminal units 11*a* and 11*b* are in contact with the inner sides of the wedge-shaped recesses 15*a* and 15*b* even somewhat so that the clamp is prevented from being idling.

As such, the present disclosure implements a new clamp capable of changing connecting direction when to install a sheet metal terminal to the battery post according to a working environment so that workability for the connection can be improved. Moreover, since the chamfers of the battery terminals are inserted into the wedge-shaped recesses of the clamp, secured and stable connection can be maintained even when an external force such as vibrations, a shock, and the like are applied.

The disclosure has been described in detail with reference to preferred embodiments thereof. However, it will be appreciated by those skilled in the art that changes may be made in these embodiments without departing from the principles and spirit of the disclosure, the scope of which is defined in the appended claims and their equivalents.

What is claimed is:

1. A clamp assembly for connecting a battery terminal to a battery post, in which the clamp assembly has a clamp body connected to terminal units of the battery terminal to tighten the terminal units, the clamp assembly comprising:

a bolt and a nut connecting side walls of the clamp body, the side walls being parallel to each other at an open end; and wedge-shaped recesses, into which chamfers of the terminal units are inserted, formed on inner sides of the side walls facing each other, wherein a chamfer of the terminal units has an inclined surface comprising inner ends which face corresponding inner ends of another chamfer and outer ends which are formed at an outer end of the inclined surface, wherein the clamp body tightens the terminal units using the wedge-shaped recesses and enables a position change between a vertical connection and a lateral connection by rotating the clamp body on the terminal units, wherein, in a case of the vertical connection, the terminal units are disposed between the side walls facing each other and only the inner ends of each chamfer are inserted into and in contact with the wedge-shaped recesses, and wherein, in a case of the lateral connection, the terminal units are disposed between the side walls facing each other and only the outer ends of each chamfer are inserted into and in contact with the wedge-shaped recesses.

2. The clamp assembly of claim 1, wherein the terminal units are tightened by a pressure due to slide contact between the wedge-shaped recesses of the side walls and the chamfers of the terminal units during the vertical connection.

3. The clamp assembly of claim 1, wherein the terminal units are tightened by a force generated when the wedge-shaped recesses of the side walls directly push the chamfers of the terminal units in the direction where the chamfers are tightened during the lateral connection.

4. The clamp assembly of claim 1, wherein a change between the vertical connection and the lateral connection is performed by rotating the side walls by 90 degrees in the state where the terminal units are inserted into the side walls.

5. The clamp assembly of claim 1, wherein edges of the wedge-shaped recesses of the side walls and edges of the terminal units are rounded.

6. The clamp assembly of claim 4, wherein edges of the wedge-shaped recesses of the side walls and edges of the terminal units are rounded.

* * * * *